US007549263B1

(12) United States Patent
Porter

(10) Patent No.: US 7,549,263 B1
(45) Date of Patent: Jun. 23, 2009

(54) STRUCTURAL INSULATED PANEL WITH HOLD DOWN CHASE

(75) Inventor: Walter Kenneth Porter, Nevada City, NV (US)

(73) Assignee: SIP Home Systems, Inc., Grass Valley, CA (US)

( * ) Notice: Subject to any disclaimer, the term of this patent is extended or adjusted under 35 U.S.C. 154(b) by 74 days.

(21) Appl. No.: 11/425,389

(22) Filed: Jun. 20, 2006

(51) Int. Cl.
*E04C 1/00* (2006.01)
*E04C 2/34* (2006.01)
*E04B 2/14* (2006.01)
*E04B 2/92* (2006.01)

(52) U.S. Cl. ..... 52/794.1; 52/309.7; 52/309.9; 52/309.11; 52/295; 52/127.7; 52/293.3

(58) Field of Classification Search ..... 52/295, 52/223.6, 223.13, 223.14, 293.3, 223.7, 127.7, 52/309.7, 309.9, 309.11, 220.3, 794.1, 167.3, 52/274, 300
See application file for complete search history.

(56) References Cited

U.S. PATENT DOCUMENTS

| | | | | | |
|---|---|---|---|---|---|
| 2,076,728 | A | | 4/1937 | Keller | |
| 3,191,146 | A | | 6/1965 | Mitchell | |
| 3,285,635 | A | | 11/1966 | Whelan | |
| 3,369,334 | A | | 2/1968 | Berg | |
| 3,464,170 | A | * | 9/1969 | Grover | 52/127.7 |
| 3,621,626 | A | | 11/1971 | Tylius | |
| 3,707,165 | A | | 12/1972 | Stahl | |
| 3,949,529 | A | | 4/1976 | Porter | |
| 4,044,511 | A | | 8/1977 | Lingle | |
| 4,136,497 | A | | 1/1979 | Porter | |
| 4,141,183 | A | | 2/1979 | Becker | |
| 4,147,004 | A | * | 4/1979 | Day et al. | 52/309.9 |
| 4,163,349 | A | * | 8/1979 | Smith | 52/241 |
| 4,688,362 | A | | 8/1987 | Pedersen | |
| 4,765,105 | A | * | 8/1988 | Tissington et al. | 52/309.11 |
| 4,936,078 | A | | 6/1990 | Porter | |
| 5,279,089 | A | * | 1/1994 | Gulur | 52/309.11 |
| 5,444,955 | A | * | 8/1995 | Ou | 52/309.9 |
| 5,465,541 | A | | 11/1995 | Lin | |
| 5,497,589 | A | | 3/1996 | Porter | |
| 5,619,829 | A | | 4/1997 | Tan | |
| 5,628,158 | A | | 5/1997 | Porter | |
| 5,678,373 | A | | 10/1997 | Franklin | |
| 5,701,708 | A | * | 12/1997 | Taraba et al. | 52/309.9 |
| 5,765,330 | A | * | 6/1998 | Richard | 52/309.13 |
| 5,771,645 | A | | 6/1998 | Porter | |
| 5,899,037 | A | * | 5/1999 | Josey | 52/267 |
| 6,058,672 | A | | 5/2000 | McLennan | |

(Continued)

FOREIGN PATENT DOCUMENTS

DE 4226977 A1 * 2/1994

(Continued)

*Primary Examiner*—Robert J Canfield
*Assistant Examiner*—James J Buckle, Jr.
(74) *Attorney, Agent, or Firm*—William Bodnar

(57) ABSTRACT

A structural insulated panel includes a structural chase or cavity to accommodate connection of the panel to an anchoring device embedded in a foundation or load bearing footing. An embodiment of the panel also includes an opening through an outer panel member providing physical and visual access to the connection within the structural chase. Another embodiment provides for an insulated structural chase also capable of accommodating an anchoring device and connecting member.

12 Claims, 5 Drawing Sheets

U.S. PATENT DOCUMENTS

| | | | | |
|---|---|---|---|---|
| 6,065,263 | A | 5/2000 | Taguchi | |
| 6,131,365 | A | 10/2000 | Crockett | |
| 6,164,035 | A | 12/2000 | Roberts | |
| 6,195,949 | B1 * | 3/2001 | Schuyler | 52/223.13 |
| 6,205,729 | B1 | 3/2001 | Porter | |
| 6,209,284 | B1 | 4/2001 | Porter | |
| 6,240,704 | B1 | 6/2001 | Porter | |
| 6,256,690 | B1 | 7/2001 | Carper | |
| 6,256,960 | B1 | 7/2001 | Babcock | |
| 6,269,608 | B1 | 8/2001 | Porter | |
| 6,301,851 | B1 | 10/2001 | Matsubara | |
| 6,308,491 | B1 | 10/2001 | Porter | |
| 6,327,829 | B1 | 12/2001 | Taguchi | |
| 6,339,907 | B1 | 1/2002 | Dame | |
| 6,367,205 | B2 | 4/2002 | Cornett | |
| 6,408,594 | B1 | 6/2002 | Porter | |
| 6,481,172 | B1 | 11/2002 | Porter | |
| 6,523,324 | B1 | 2/2003 | Porter | |
| 6,588,172 | B2 | 7/2003 | Porter | |
| 6,698,157 | B1 | 3/2004 | Porter | |
| 6,854,230 | B2 * | 2/2005 | Starke | 52/481.1 |
| 6,951,078 | B2 | 10/2005 | Espinosa | |
| 7,150,132 | B2 | 12/2006 | Commins | |
| 7,159,366 | B2 | 1/2007 | Espinosa | |
| 2003/0167711 | A1 | 9/2003 | Lstiburek | |
| 2004/0103601 | A1 | 6/2004 | Bergqvist | |
| 2007/0101678 | A1 | 5/2007 | Miniter | |

FOREIGN PATENT DOCUMENTS

| | | |
|---|---|---|
| EP | 387127 | 12/1990 |

* cited by examiner

STRUCTURAL INSULATED PANEL WITH HOLD DOWN CHASE

CROSS REFERENCE TO RELATED APPLICATIONS

None.

FIELD OF THE INVENTION

This present invention relates to structural insulated panels that are utilized in building construction and in particular to a building system employing structural insulated panels that are connected to rods or anchors embedded in a foundation or a load bearing footing.

BACKGROUND OF THE INVENTION

The majority of houses constructed are stick built, i.e., typically constructed of 2 by 4 or 2 by 6 structural members and nails. Wallboard is typically attached to the structural members in forming the walls and ceilings of the stick built house. Structural Insulated Panel's (SIPs) are increasingly being used in building construction as an alternative to the stick built approach. SIP construction employs rigid outer facings attached to one or both sides of a light insulating foam core. High strength bonding of the outer facings to the inner core forms a structural I-beam in the form of flat panels. Previously mentioned wallboard panels as well as SIPs are attached to the 2 by 4 or 2 by 6 structural members by conventional connectors such as nails or screws.

SIPs are attached to the base (or bottom) and top plates forming part of the 2 by 4 or 6 lumber framework as well as to spaced studs extending between the base and top plates. Current building codes and engineering specifications often require a particular wall or wall section to be a "shear-wall". These walls or wall sections are typically connected to a foundation or footing by use of a "hold-down" or "tie-down".

High strength and/or reinforced metal rods are typically embedded in a foundation or load bearing footing to provide an anchor for securing a wall section to the ground. Anchors are utilized to counter the forces acting on a wall that will cause the wall to turn or tip over. Hold-downs or tie-downs are used connect a wall section to the ground and prevent a wall from overturning. The terms hold-downs and tie-downs are often used interchangeably and refer to the system of components use to secure the wall to the foundation or footing.

Hold-downs can take many forms. Some look like straps that emerge from the foundation and nail to the edge or face of a stud. Others connect foundation bolts or threaded rods to the studs via bolts or nails. The hold-down creates a path for forces to travel out of a shear wall and into other portions of the building.

SIP users often attach one or more panel sections to a threaded rod embedded in a foundation or footing as per design specifications. However, methods of attachment of the SIP to the embedded rod have proved time-consuming and costly for most users. Also, previous attachment methods have provided connections in the lower section of the panel, thus not taking advantage of the strength and shear-resistance of the entire panel.

SUMMARY OF THE INVENTION

Embodiments of the present invention address the aforementioned limitations of previous attachment methods and devices by providing an SIP panel with a structural chase to easily accommodate a connection for a rod or anchor embedded in a foundation or load bearing footing. The structural chase of embodiments of the present invention is formed by using structural members to create a cavity that extends the entire length of the panel.

Structural members commonly used to form the chase are solid wood, laminated veneer lumber (LVL) or any suitable structural equivalent utilized in building construction. Through utilization of a chase or cavity defined by structural members, embodiments of the present invention provide a lightweight, structural insulated panel capable of forming high strength connections to hold down anchorage attachments in a foundation or footing with a minimum of connectors within the panel. The structural chase described herein also increases the bending strength and the compressive strength of the panel.

Accordingly, it is an object of an embodiment of the present invention to provide a building system employing a modular structural insulated panel which reduces the need for timely and costly methods and devices to anchor a panel to the foundation or footing. It is a further object to provide a structural insulated panel designed to accommodate a reinforcing rod within a panel cavity while maintaining or increasing the structural and insulative properties of the panel.

It is also an object of an embodiment of the present invention to decrease the time and expense of anchoring a structural insulated panel to a foundation or load-bearing footing. Yet another object is to provide a structural insulated panel that can be anchored to a foundation and allow for accessible inspection and/or verification by a building inspector.

It is another object of an embodiment of the present invention to provide a structural insulated panel design that can meet the requirements of building codes including, but not limited to, the International Residential Code (IRC). At least some of these objects will be achieved by embodiments disclosed herein.

BRIEF DESCRIPTION OF DRAWINGS

The character of the invention, however, may be best understood by reference to one of its structural forms, as illustrated by the accompanying drawings, in which.

DETAILED DESCRIPTION OF THE PREFERRED EMBODIMENTS

Figure 1:
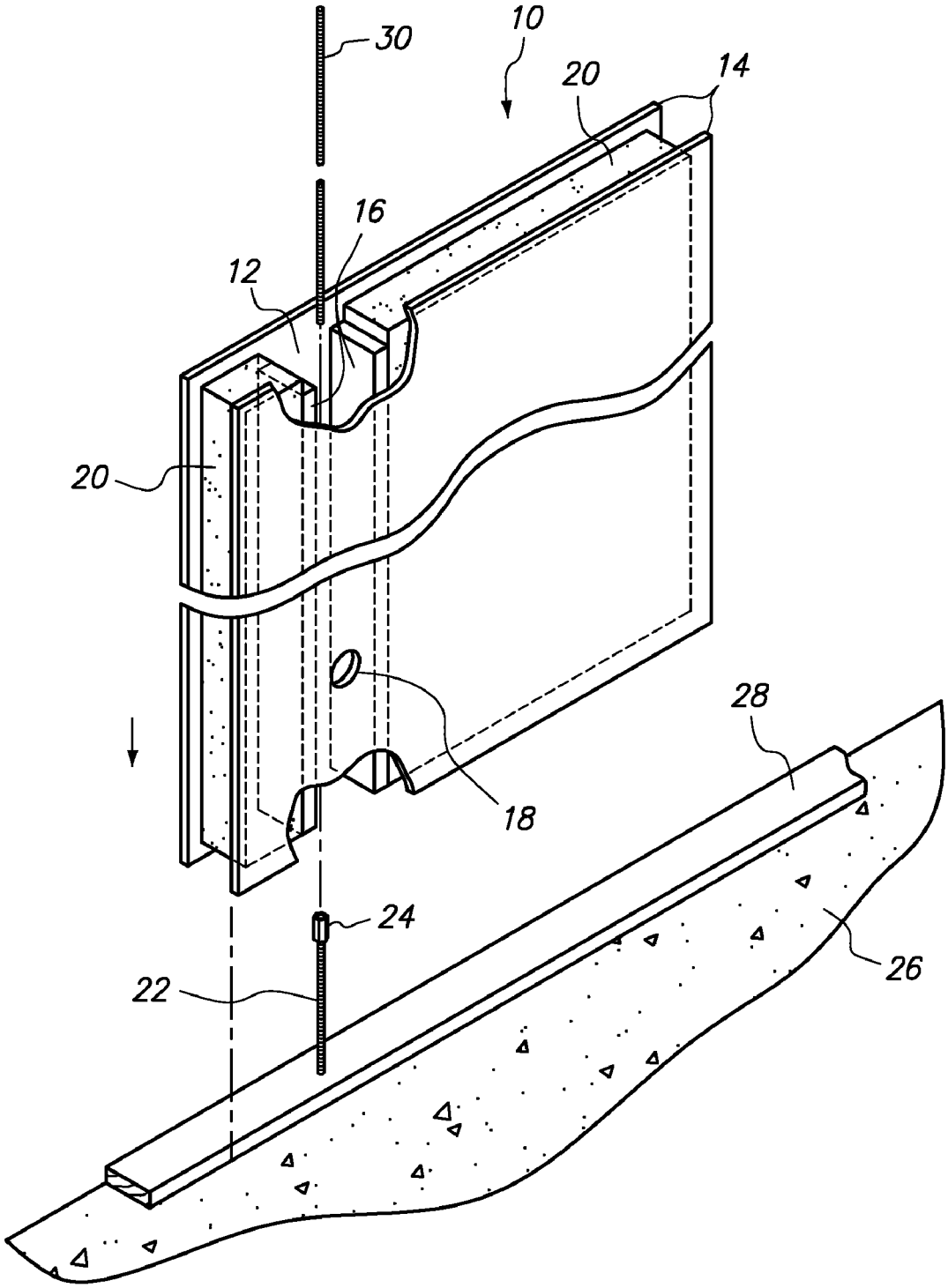
FIG. 1 is a perspective view of a structural insulated panel projected above a building foundation.

Referring to FIG. 1, which best shows the general features of an embodiment of the invention, the structural insulated panel 10 is shown as being comprised of two sheets of OSB panels 14 sandwiching a foam core 20 and a structural chase 12. The structural chase is bounded on two sides by the OSB panels and on two other sides by structural members 16. The chase is designed to house the imbedded (or bottom) rod 22, the threaded (or upper) rod 30 and the coupler 24 which connects both rods. An opening 18 is cut into the OSB panel 14 to give physical and/or visual access to the rods and coupler within the chase. The bottom rod 22 is embedded into the foundation 26 and passes through the bottom plate 28 in a typical installation.

Figure 2:
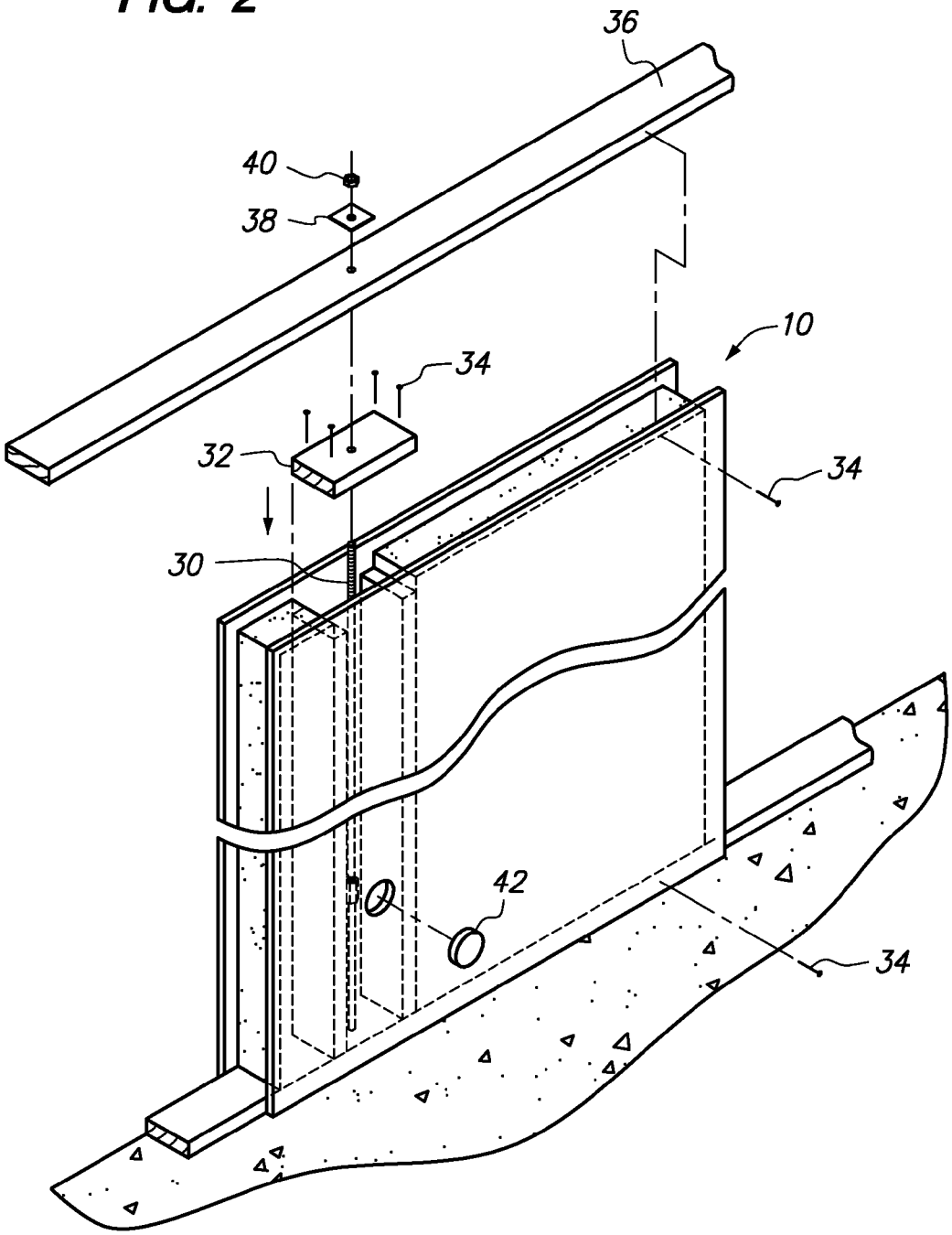
FIG. 2 is a view of a structural insulated panel set in place on a building foundation.

FIG. 2 shows the structural insulated panel 10 placed in position over the foundation and bottom plate with the embedded rod fitted within the structural chase. The top rod is shown connected to the embedded rod via the coupler. A plug 42 would be used to cover the access hole after installation. A top block 32 completes the top of the structural chase. The top block is typically attached with fasteners or nails 34 and has an opening to accommodate the threaded rod. A top plate 36 covers the top portion of the structural insulated panel and a washer 38 and nut 40 are used to secure the panel to the foundation. Various types of high strength washers or nuts can be used as well as other common spacers and fasteners.

Figure 3:
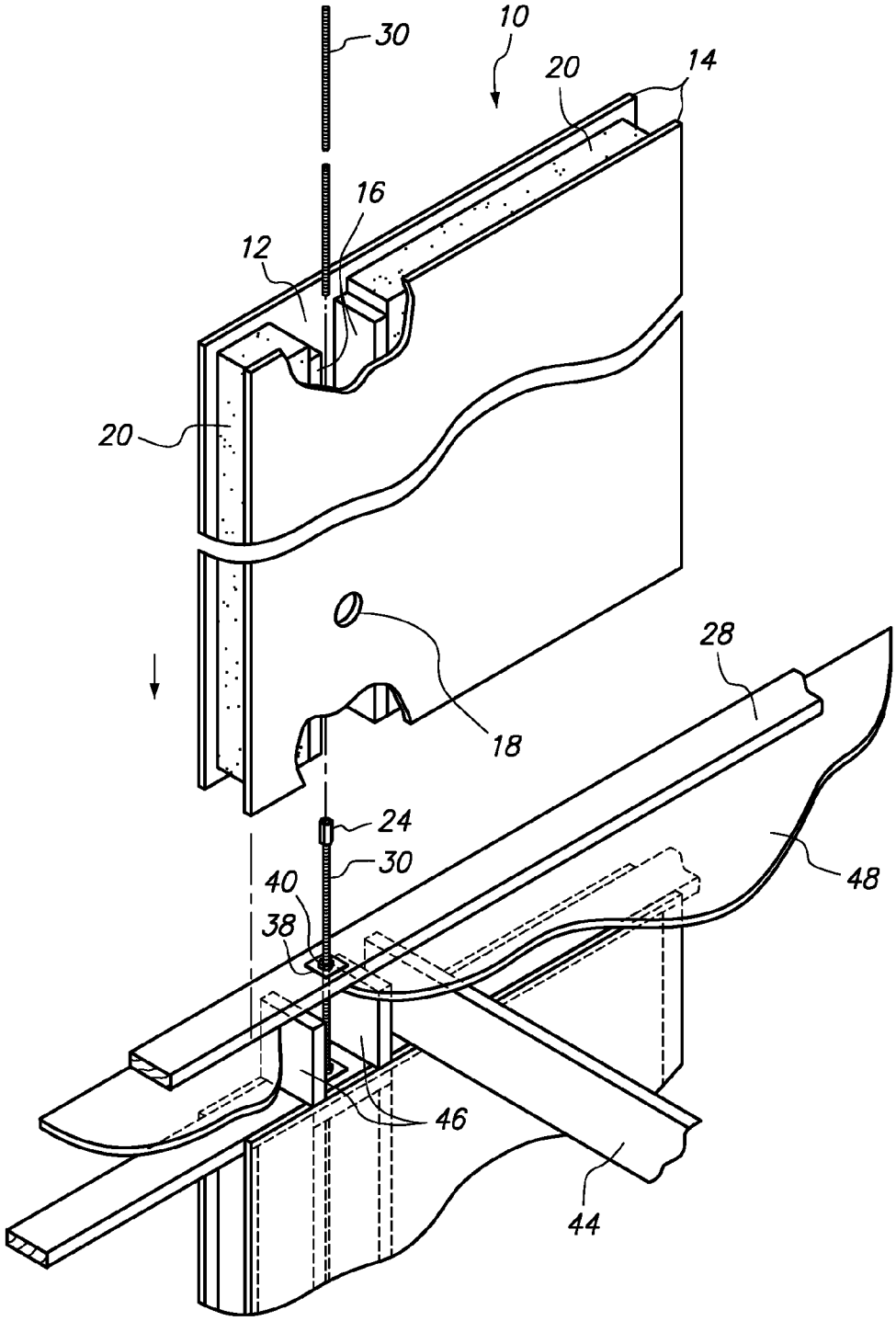
FIG. 3 is a view of a structural insulated panel projected above the floor on a multi-story application.

FIG. 3 is a detailed view of a structural insulated panel projected over the subfloor 48 and bottom plate 28 of a multi-story building. In multi-story applications, panels installed above the ground floor will utilize the threaded rod 30 as a bottom rod instead of a rod embedded in the foundation. Adjacent to a floor joist 44, blocking 46 is used to provide structural support under the panel chase 12. A bottom plate 28 is installed above the floor joist and the blocking. The bottom plate has an opening to accommodate the threaded rod 30. A washer 38 and nut 40 are used to secure the threaded rod 30 to the bottom plate, etc. A coupler 24 is utilized to connect the two rods 30 together as previously disclosed.

Figure 4:
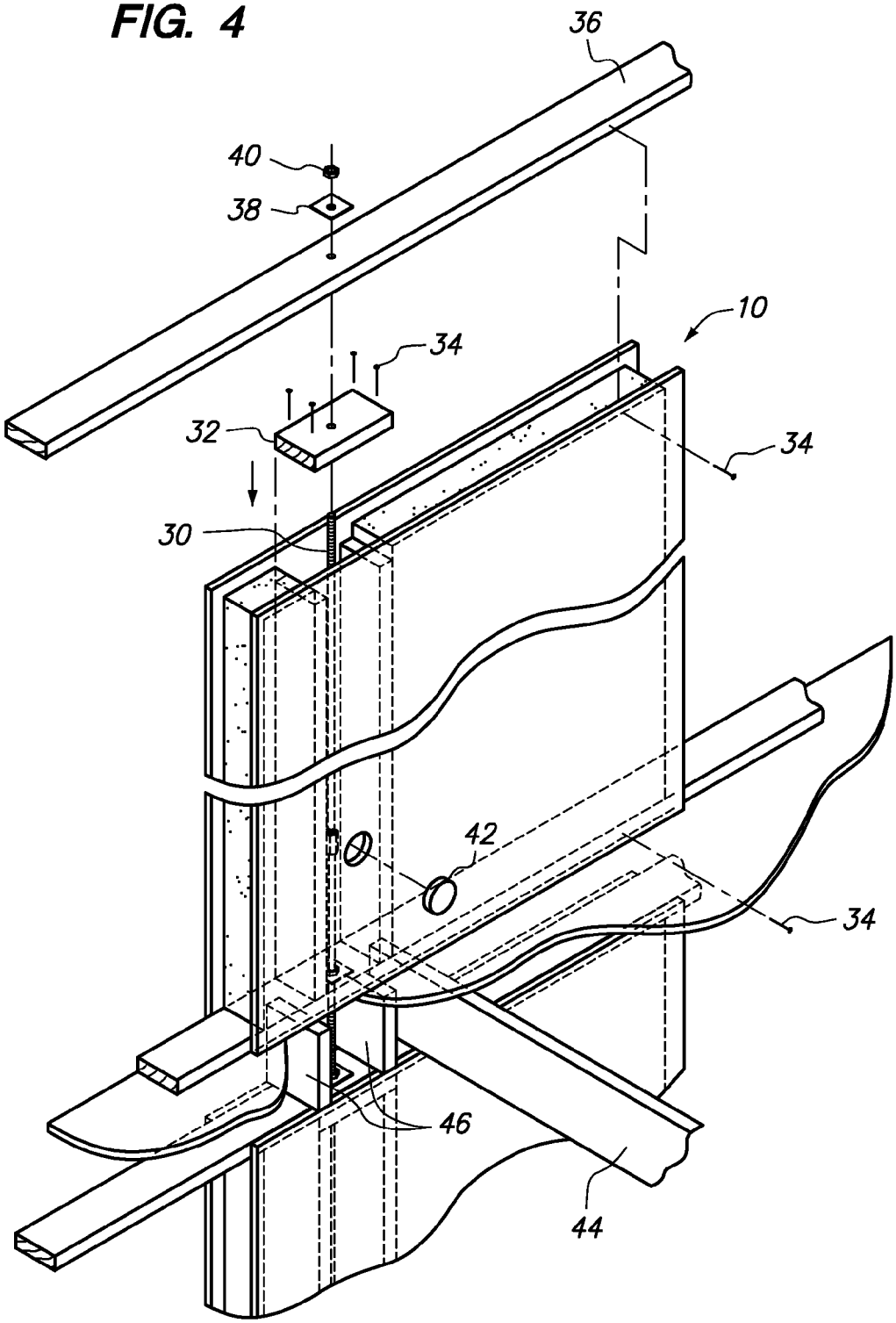
FIG. 4 is a view of a structural insulated panel set in place on a floor of a multi-story building.

FIG. 4 shows the panel set in position above the ground floor on a multi-story application. Installation of the structural insulated panel at this point is similar to, if not identical with, installation of the panel described along with FIG. 2.

Figure 5:
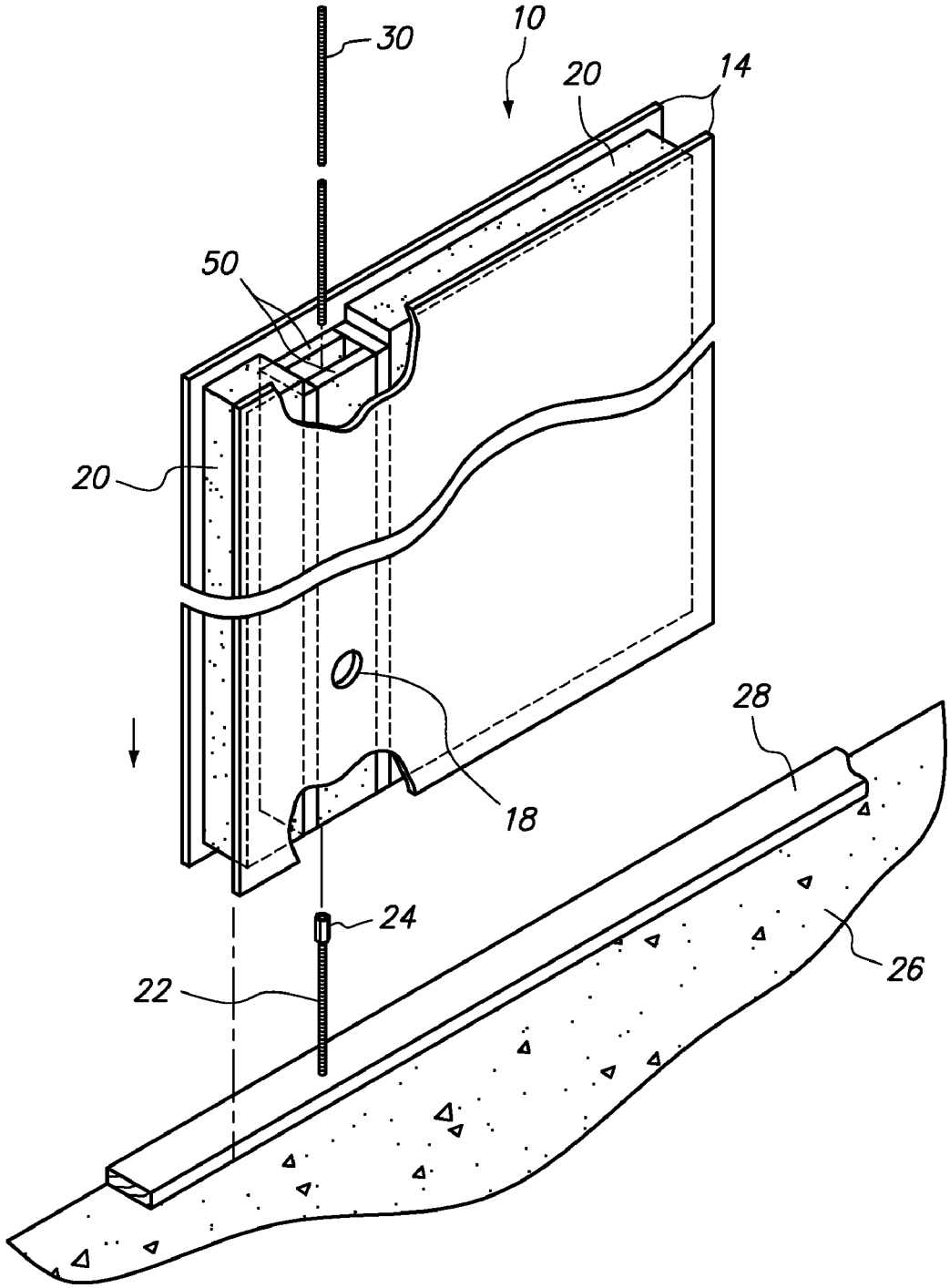
FIG. 5 is a view of a structural insulated panel with a chase defined on two sides by insulation.

FIG. 5 shows another embodiment of the structural insulated panel with additional insulation 50 lining the chase. In this embodiment the chase is defined on two sides by insulation 50 and on two sides by structural members 16. The chase in FIG. 5 is designed to house the imbedded (or bottom) rod 22, the threaded (or upper) rod 30 and the coupler 24 which connects both rods. An advantage of this design is that the additional insulation lessens the heat loss or gain though the chase section of the structural insulated panel. An opening 18 is cut into the OSB panel 14 and the insulation 50 to give physical and/or visual access to the rods and coupler within the chase.

CONCLUSIONS, OTHER EMBODIMENTS, AND SCOPE OF INVENTION

Embodiments of the present invention provide a structural insulated panel that can be quickly and easily anchored to an embedded rod in a foundation or load bearing footing without the need for time-consuming and expensive attachments. The unique design presented herein provides for a structural chase to house at least one embedded rod, an attachment element, and a connecting rod to anchor the panel to the foundation or footing.

An embodiment of the structural insulated panel of the present invention could also be utilized in a multi-story application (FIGS. 3 and 4). In such applications, SIPs would be stacked above one another with the chases aligned to accommodate reinforced and/or threaded rods. While the panel on the ground level would utilize a rod embedded in a foundation or footing as the bottom rod, an SIP above the ground floor would utilize the top rod of the panel below as an anchoring device.

An important characteristic of SIPs is their insulative properties. The unique chase in the SIPs of the present invention allows insulation in the chase itself without interfering with the structural rods and connector. An access hole can be cut through the outer member (OSB panel for example) as well as the rigid insulation lining the chase (FIG. 5). Use of such a panel could further improve the energy efficiency of a building while maintaining the structural integrity of the panel and wall. Other types of insulation are contemplated such as loose fill, batt and blown in varieties. However, pre-installed rigid insulation would eliminate the need to add insulation at the construction site. Embodiments of the panel of the present invention allow building inspectors to verify the anchoring connection within the chase. An access hole can easily provide a view of the coupler and rods after installation. A plug can be inserted into the panel to cover the access hole after inspection. The access hole also provides valuable access to the coupler and rod(s) during the installation process. The plug can also help maintain the structural integrity of the panel and minimize the effects of adverse weather while awaiting inspection.

The structural members that define the chase are typically 2 by 4 or 2 by 6 lumber and can be comprised of solid wood or laminated veneer lumber (LVL). Any structural member will suffice. The chase's structural members also provide the panel with more resistance to compressive loads acting though the top plate or tensile loads through the metal rod anchored in the foundation or footing.

Structural members in building panels typically are comprised of engineered wood product. All engineered wood products utilize recycled or reconstituted wood materials. Structural composite lumber is a type of engineered wood product that includes laminated veneer lumber (LVL), parallel strand lumber (PSL), laminated strand lumber (LSL) and oriented strand lumber (OSL). Other common terms used to describe engineered wood products are oriented strand board (OSB), plywood and particleboard. Structural glued laminated timber (Glulam) is also considered an engineered wood product.

The connecting rods typically utilized are commonly referred to as embedded rods, allthread, and threaded rods. Any type of connector that can accept and couple threaded portions of the rods can be utilized within the chase. A washer and nut are commonly used to secure the rod to the top plate. Any suitable fastener and spacing component can be utilized within the scope of the embodiments of the present invention.

In some heavy duty applications, the chase can be defined by more than two structural members between the outer members of the panel. On tall buildings, there could be four structural members or struts (possibly two on each side of the chase) to provide a stronger panel.

When shear-walls are specified by building plans and/or design, a panel described herein would be utilized near one end of the shear-wall. The chase would typically be positioned next to the end or corner of the building. Another similar panel would be placed on the opposite end of the wall with the chase positioned near the building corner or the end of the wall. It should be further noted that application of the embodiments of the present invention are not limited to exterior walls. These embodiments can also be used for interior load bearing walls on a foundation or load bearing footing.

While the illustrations show one embedded rod in each chase, there may be applications where more than one embedded rod is required. In yet another embodiment, the panels could also comprise more than one chase if necessary.

Other embodiments of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. A structural insulated panel adapted to receive at least one structural rod therein, said structural insulated panel comprising:

two substantially parallel, rigid outer facings, each outer facing comprising an inner panel surface and outer panel surface of similar area, and at least four edge surfaces, said edge surfaces comprising a top edge, a bottom edge and two side edges;

a first insulating core comprising two outside surfaces of similar area and a top edge, bottom edge and two side edge surfaces, said area of each first insulating core outside surface equal to less than the area of each inner panel surface of said outer facings, said first insulating core sandwiched between and attached to the inner surfaces of said outer facings at said first insulating core outer surfaces such that the edges of the outer facings overlap the top edge, bottom edge and one side edge surface of said first insulating core by a first distance, a first continuous structural inner member sandwiched between and attached to the inner surfaces of said outer facings, said first structural inner member substantially parallel to and adjacent a side edge surface of said first insulating core, said first structural inner member extending approximately from the bottom edge of said first insulating core to a second distance from the top edge of said first insulating core, said second distance approximately equal to said first distance;

said first continuous structural inner member positioned approximately parallel to and a third distance from the nearest side edges of said rigid outer facings, said third distance greater than said first distance.

2. The structural insulated panel of claim 1 further comprising second and third sections of insulating core, said second section of insulating core positioned adjacent to said first inner member and an inner surface of an outer facing, said third section of insulating core positioned adjacent to an inner surface of said first inner member and an inner surface of an outer facing, said panel having an insulated cavity defined on two sides by said second and third sections of insulating core and on one side by said first structural inner members.

3. The structural insulated panel of claim 1 further comprising a second continuous structural member sandwiched between and attached to the inner surfaces of said outer facings, said second structural inner member approximately parallel to and at least a fourth distance from said first structural inner member, said fourth distance less than said third distance, said second structural inner member extending from a plane approximately aligned with a bottom edge of said first structural inner member to a plane approximately aligned with a top edge of said first structural inner member.

4. The structural insulated panel of claim 3 further comprising a second insulating core having two outer surfaces of similar area and a top edge, bottom edge and two side edge surfaces, said second insulating core sandwiched between and attached to the inner surfaces of said outer facings at said second insulating core outer surfaces such that the edges of the outer facings overlap the top edge, bottom edge and one side edge surface of said second insulating core by a first distance, said second insulating core positioned between said second continuous structural member and the nearest side edge surfaces of said outer facings.

5. The structural insulated panel of claim 1 further comprising at least one upper structural member utilized as a top block.

6. The structural insulated panel of claim 5 further comprising at least one lower structural member utilized as a bottom plate.

7. The structural insulated panel of claim 2 further comprising at least one upper structural member utilized as a top block.

8. The structural insulated panel of claim 7 further comprising a second upper structural member utilized as a top plate.

9. A structural insulated panel adapted to receive at least one structural rod therein, said structural insulated panel comprising:

two substantially parallel, rigid outer facings, two substantially parallel, unconnected structural inner members attached to and situated between said outer facings;

an insulating core between said outer facings, said core comprising a first and second section separated by said inner members;

said structural inner members comprising solid wood or engineered wood products, said panel comprising a cavity defined on two sides by said inner members, said cavity extending from a top end of said panel to a bottom end of said panel;

at least one of said outer facings further comprising an aperture to provide access to said cavity, and at least two spaced, substantially parallel, vertically extending third and fourth sections of said insulating core, each third and fourth section positioned between said at least two inner members, said panel having an insulated cavity defined on two sides by said third and fourth sections of insulating core and on two sides by said structural inner members.

10. The structural insulated panel of claim 9, wherein at least one of said third or fourth sections of insulating core further comprises an aperture to provide access to said cavity and a plug to fit into said aperture.

11. The structural insulated panel of claim 1 wherein said rigid outer facings are comprised of engineered wood products.

12. The structural insulated panel of claim 9 wherein said rigid outer facing members are comprised of engineered wood products.

* * * * *